US006116546A

United States Patent [19]

Burkhart

[11] Patent Number: 6,116,546

[45] Date of Patent: Sep. 12, 2000

[54] METHOD FOR PRODUCING A RAILWAY CROSSING WARNING SIGNAL

[76] Inventor: Ford N. Burkhart, 1203 N. High St., Newton, Kans. 67114-2338

[21] Appl. No.: 09/271,792

[22] Filed: Mar. 18, 1999

[51] Int. Cl.[7] ..... B61L 29/00

[52] U.S. Cl. ..... 246/473.1; 246/473 R; 246/473.3; 246/477

[58] Field of Search ..... 246/473 R, 473.1, 246/473.3, 477

[56] References Cited

U.S. PATENT DOCUMENTS 2,262,239 11/1941 Kennelly ..... 246/473

*Primary Examiner*—S. Joseph Morano
*Assistant Examiner*—Robert J. McCarry, Jr.

[57] ABSTRACT

This invention, is a PROCESS, for creating a flashing red light at a railroad-highway grade crossing.

This PROCESS is accomplished by the use of two units. The first unit houses a light that is capable of casting a very intense beam out ahead of the train. It also houses a means to oscillate this light from side to side (left and right) using a motor mechanism, like a heavy duty windshield wiper motor.

The second unit is a round, red reflector that is capable of reflecting the light in both directions down the roadway that intersects the railway. This PROCESS is accomplished as the oscillating light beam strikes the red reflector for just a split second with each pass, creating the appearance of a flashing red light, which causes motorists, and others, to know that a train is approaching the grade crossing.

The reflector is shaded from the sunlight, leaving it in relative darkness. This enable motorists to see the reflection (the flashing red light) even during daylight hours. The light unit is mounted securely to the front of the train at approximately 13 to 15 feet above the railroad tracks. The reflector unit is installed at the grade crossing at the same height as the light unit.

2 Claims, No Drawings

METHOD FOR PRODUCING A RAILWAY CROSSING WARNING SIGNAL

SEARCH RESULTS

U.S. patent documents

U.S. Pat. No. 1,316,082 Sep. 16, 1919 Cherry

U.S. Pat. No. 1,467,892 Sep. 11, 1923 Bergen

U.S. Pat. No. 1,515,939 Nov. 18, 1924 Edwards

U.S. Pat. No. 1,594,443 Aug. 3, 1926 Bard

BACKGROUND OF THE INVENTION

This invention, which is a new PROCESS for producing a railroad grade crossing signal, was conceived in my mind in early 1971. I have chosen to name it The Burkhart Safety System. I have paid for two professional searches, and have performed by own personal search at the Patent and Trademark Library on the campus of Wichita State University. In these searches nothing was found that would cause my claims to be considered an infringment on the prior art. The long period from conception to patent application is due primarily to lack of funds with which to hire a patent attorney. Therefore, as a Pro Se applicant, I am hereby submitting my application, which falls in the catagory of a Utility Patent.

I want to make it clear that I make no representation of inventing a light source, nor a means of oscillating it to accomplish its purpose. Neither am I inventing a reflector. These things have already been invented. I am, rather, submitting an application for a PROCESS, the purpose of which is to produce a desired result which will be described in the following specification and claims.

Several different configurations of lights, mechanical apparatus, housings, etc. could be used to facilitate this Process that will produce the desired result. Therefore, the accompanying drawings are submitted only to illustrate a general, but very close, conception of how the Process is produced. This concept is very simple, but I believe it meets the criteria of uniqueness and non-obviousness due to the fact that this invention has never been tried.

I hereby declare that this invention has not been produced, advertised, sold or used. It has not been published anywhere, nor revealed to the public.

Finally, It has come to my attention that the PTO will give special consideration and priority to patent applications submitted by inventors who are over 65 years of age, due to the fact that they will have less time to enjoy the fruits of their labors. I respectfully request that this thoughtful consideration be given to this inventor. I am 68 years of age.

TECHNICAL FIELD

This invention relates to the field of railway-highway crossing safety, and, in particular, to the art of grade crossing signal technology.

DESCRIPTIONS OF THE PRIOR ART

Some of the inventions referenced above are different enough from this invention that they are not relevant for comparison. All of them rely on using the locomotive's headlight, which is not focused enough to make a device at the crossing effectively accomplish it's purpose. One of these inventions (U.S. Pat. No. 1,594,443—Bard) attempts to accomplish the same purpose as my invention, but, in my opinion, falls woefully short for several reasons as follows. It will work, if it works at all, only on a straight track. It uses a shutter contraption that causes the headlight of the locomotive to flicker, which defeats the purpose of having a headlight and would probably be extremely annoying to the engineer/s.

It employs a series of linkages from the wheels to the shutter which could easily fail, endangering the crew and anyone in close proximity. It uses glass mirrors at the crossing, which are very likely to eventually break. No mention is made of a RED light, which the driving public expects to see and the regulatory agencies have mandated as the color of a signal light at the crossing. The whole concept of Bard's invention was designed to be used with the steam locomotives that were in general use when the patent was issued. Therefore, this long expired patent differs greatly from the patent I am seeking for The Burkhart Safety System.

The following references to specific art-related problems involved in the prior art, and which are solved by my invention, are a result of my considerable research. Those involved with railroad crossing safety see the need for a triangular view of the track as a vehicle approaches the crossing. In other words, the driver should be able to see several hundred yards of track on both sides of the crossing while said driver is still a hundred yards or more from reaching the crossing. In many cases this is impossible due to buildings, trees, etc. obstructing the view.

One warning system employs a horn (not the locomotive horn) to warn oncoming drivers of the train's approach. If the driver happens to be deaf, or if the vehicles windows are tightly closed, the driver may not hear the horn. Also, the horn may be a tremendous source of irritation to the neighborhood around the crossing.

Much of the prior art relies on the locomotive headlight, the purpose of which is to illuminate a rather broad area ahead of the train, to produce a signal. In the prior art, nearly all of those inventions that use a reflector call for a flat surfaced reflector which will reflect the light source in one direction only.

Many railroads and departments of transportation are closing passive crossings to lessen the possibility of collisions involving vehicles and trains. Passive crossings are those that are equipped with the crossbuck only,—no lights or gates. This is expensive and poses a big inconvenience to local motorists who rely on those crossings on a daily basis.

SUMMARY OF THE INVENTION

This invention, The Burkhart Safety System, answers all of the aforementioned problems regarding public safety at passive railroad-highway grade crossings.

With may invention, all the motorist needs to see is the reflector, straight ahead, making the triangular view less imperative. This invention makes a horn at the crossing unnecessary. My invention employs a separate light source which is of the proper and necessary intensity and focus. This invention uses a highly reflective material, fastened to a vertical cylinder situated at the crossing. This type of reflector will reflect the light source in both directions, left and right, in excess of 180 degrees.

This wide range of reflection effectively warns motorists who are traveling at an angle to or parallel to the tracks as they approach the crossing. For much less than it would cost to close a crossing, departments of transportation, governmental units or regulatory agencies could just install The Burkhart Safety System and leave the crossing open.

This Summary continues with my description of the Burkhart Safety System, as follows.

This invention is an improvement on the prior art of railroad crossing signal systems. The purpose of this invention is to provide an effective signal at railroad grade crossings to warn drivers of motor vehicles that a train is approaching. This system which is a PROCESS, employs two units: the oscillating light source. located on the locomotive, and the reflector. which is situated at the railway-highway grade crossing.

The light source projects a spotlight type beam of light out ahead of the locomotive. As the light oscillates from side to side the narrow beam of light sweeps the area ahead of the train, hitting the red reflector for only a split second with each pass. This PROCESS creates the appearance of a flashing red light at the crossing.

The reflector is situated on a post attached to, or next to, the conventional railroad crossbuck. When the light beam hits the red reflector, it is reflected in both directions, left and right, to warn oncoming traffic that a train is approaching the crossing. This type of reflector will feflect the light source at well over a 180 degree range.

This system has several advantages over present methods. The main advantage is the low cost of equipment and installation. The conventional alternating crossing lights can cost in excess of one hundred thousand dollars per singe grade crossing. The are more than 200,000 passive grade crossings in the United States. These crossings can not, and will not, be equipped with conventional signal lights due to the prohibitive costs. The Burkhart Safety System can be installed for possibly less than $700 per crossing. Another important advantage is that no electrical service is needed at the crossing. The motoring public can quickly become accustomed to this warning signal.

The Burkhart Safety System can save countless lives and prevent many millions of dollars in property losses.

What is claimed is:

1. A method for producing a flashing light at a railroad crossing comprising the steps of:

mounting light means on a locomotive;

positioning reflecting means at a railroad crossing;

oscillating said light means to produce a sweeping light beam which passes said reflecting means in a periodic manner.

2. The method of claim 1 wherein the reflector means reflects the light at an angle to the locomotive.

* * * * *